US008106339B2

(12) United States Patent
Robbins et al.

(10) Patent No.: US 8,106,339 B2
(45) Date of Patent: Jan. 31, 2012

(54) MICROWAVE HEATING PACKAGE WITH THERMOSET COATING

(75) Inventors: David William Robbins, Larsen, WI (US); Scott W. Middleton, Oshkosh, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 1237 days.

(21) Appl. No.: 11/821,850

(22) Filed: Jun. 26, 2007

(65) Prior Publication Data

US 2008/0000897 A1 Jan. 3, 2008

Related U.S. Application Data

(60) Provisional application No. 60/818,358, filed on Jun. 30, 2006.

(51) Int. Cl.
*H05B 6/80* (2006.01)

(52) U.S. Cl. ..... 219/730

(58) Field of Classification Search ..... 219/730, 219/725, 727, 729, 732, 734, 735, 759, 762; 426/107, 113, 115, 234; 428/35.8, 34.3; 156/233, 272.2, 230
See application file for complete search history.

(56) References Cited

U.S. PATENT DOCUMENTS

| | | | | |
|---|---|---|---|---|
| 4,775,771 | A | | 10/1988 | Pawlowski |
| 4,777,053 | A | * | 10/1988 | Tobelmann et al. ..... 426/107 |
| 4,865,921 | A | | 9/1989 | Hollenberg |
| 4,890,439 | A | | 1/1990 | Smart |
| 4,936,935 | A | | 6/1990 | Beckett |
| 4,963,424 | A | | 10/1990 | Beckett |
| 5,039,364 | A | | 8/1991 | Beckett et al. |
| 5,117,078 | A | | 5/1992 | Beckett |
| 5,213,902 | A | | 5/1993 | Beckett |
| 5,221,419 | A | | 6/1993 | Beckett |
| 5,260,537 | A | | 11/1993 | Beckett |
| 5,266,386 | A | | 11/1993 | Beckett |
| RE34,683 | E | | 8/1994 | Maynard |
| 5,340,436 | A | | 8/1994 | Beckett |
| 5,354,973 | A | | 10/1994 | Beckett |
| 5,410,135 | A | | 4/1995 | Pollart |
| 5,424,517 | A | | 6/1995 | Habeger |
| 5,519,195 | A | | 5/1996 | Keefer |
| 5,628,921 | A | | 5/1997 | Beckett |
| 5,672,407 | A | | 9/1997 | Beckett |
| 5,759,422 | A | | 6/1998 | Schmelzer |

(Continued)

FOREIGN PATENT DOCUMENTS

| | | |
|---|---|---|
| WO | WO 98/22654 | 5/1998 |

(Continued)

OTHER PUBLICATIONS

U.S. Appl. No. 11/673,136, filed Feb. 9, 2007, Middleton.

*Primary Examiner* — Quang Van
(74) *Attorney, Agent, or Firm* — Womble Carlyle Sandridge & Rice, LLP

(57) ABSTRACT

A construct for heating, browning, and/or crisping a food item in a microwave oven includes a panel having a first surface and a second surface opposite the first surface, a microwave energy interactive material overlying at least a portion of the first surface, wherein the microwave energy interactive material generates heat when exposed to microwave energy, and a thermally stable coating overlying at least a portion of the second surface.

15 Claims, 2 Drawing Sheets

U.S. PATENT DOCUMENTS

| | | | | |
|---|---|---|---|---|
| 5,800,724 | A | 9/1998 | Habeger | |
| 6,114,679 | A | 9/2000 | Lai | |
| 6,150,646 | A | 11/2000 | Lai | |
| 6,193,831 | B1 * | 2/2001 | Overcash et al. | 156/230 |
| 6,204,492 | B1 | 3/2001 | Zeng | |
| 6,251,451 | B1 | 6/2001 | Zeng | |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek | |
| 2004/0023000 | A1 * | 2/2004 | Young et al. | 428/138 |
| 2005/0205565 | A1 | 9/2005 | Cole | |
| 2006/0049190 | A1 | 3/2006 | Middleton | |
| 2006/0113300 | A1 | 6/2006 | Wnek | |
| 2006/0278521 | A1 | 12/2006 | Stowell | |

FOREIGN PATENT DOCUMENTS

| | | |
|---|---|---|
| WO | WO 03/066435 | 8/2003 |

* cited by examiner

MICROWAVE HEATING PACKAGE WITH THERMOSET COATING

CROSS-REFERENCE TO RELATED APPLICATION

This application claims the benefit of U.S. Provisional Application No. 60/818,358, filed Jun. 30, 2006, which is incorporated by reference herein in its entirety.

TECHNICAL FIELD

The present invention relates to a various packages and constructs for heating, browning, and/or crisping a food item, and particularly relates to various packages and constructs for heating, browning, and/or crisping a food item in a microwave oven.

BACKGROUND

Microwave ovens provide a convenient means for heating a variety of food items, including many items that ideally are browned and/or crisped, for example, French fries, egg rolls, pizza snacks, and chicken nuggets. However, microwave ovens tend to cook such items unevenly and are unable to achieve the desired balance of thorough heating and a browned, crisp outer surface. As a result, many packages have been devised to improve the browning and/or crisping of such items. Such packages may include one or more microwave energy interactive elements that, for example, convert microwave energy to thermal energy to promote browning and/or crisping of the food item. In some instances, the thermal energy may be transferred to the various other components that form the package, for example, the printing or other coatings on the exterior of the package, thereby causing the coatings to soften slightly. When such coatings are on the bottom of the package, the softened coating may tend to adhere to the turntable or floor (collectively "floor") of the microwave oven. As a result, when the package is removed from the microwave oven, a portion of the coating may be transferred to the turntable or floor, thereby leaving an unsightly stain or mark that must be cleaned or removed by the user. This phenomenon commonly is referred to as "picking". Thus, there is a need for improved materials and packages that provide the desired degree of heating, browning, and/or crisping of food items in a microwave oven without causing unsightly picking, or transfer of the package coating to the floor of the microwave oven.

SUMMARY

The present invention is directed generally to various sleeves, pouches, trays, cartons, packages, systems, or other constructs (collectively "constructs") for heating browning, and/or crisping one or more food items in a microwave oven, various materials and blanks for forming such constructs, various methods of making such constructs, and various methods of heating, browning, and/or crisping one or more food items in a microwave oven.

A construct according to the invention includes at least one panel, portion, or segment having a first surface and a second surface, where, for example, the first surface corresponds to an inner surface of a construct or a food-contacting surface of a construct, and the second surface corresponds to a surface of the panel opposed to the first surface. The second surface may be an outer surface of the construct, for example, a surface that is intended to or capable of contacting the floor of the microwave oven.

In one aspect, at least one microwave energy interactive element that enhances or otherwise alters the microwave heating, browning, and/or crisping of a food item or items at least partially covers or overlies the first surface of at least one panel or portion of the construct. The microwave energy interactive element may be a browning and/or crisping element, a shielding element, an energy directing element, or any other suitable element. In one particular example, the microwave energy interactive element comprises a susceptor or susceptor film that tends to heat upon exposure to microwave energy, thereby enhancing the browning and/or crisping of an adjacent food item.

In another aspect, a coating at least partially overlies or covers the second surface of at least one panel or portion of the construct. The coating may comprise one or more layers of inks, dyes, varnishes, and/or other components. At least the outermost layer comprises a thermally stable coating. More particularly, at least the outermost layer or portion of the coating comprises a heat resistant coating. In one aspect, the heat resistant coating comprises a thermoset polymer that does not tend to soften or deform when exposed to thermal energy, or heat. Any thermoset polymer may be used, for example, a coating cured using ultraviolet (UV) radiation or electron beam (EB or E-beam) radiation. Numerous coatings are contemplated for use with the present invention including, but not limited to, those set forth herein.

In still another aspect, a construct includes at least one panel, portion, or segment having a first surface and a second surface opposed to the first surface, where a microwave energy interactive element, for example, a susceptor or susceptor film, overlies a portion of the first surface, and a coating comprising a thermoset polymer overlies at least a portion of the second surface. When the construct is exposed to microwave energy, the microwave energy interactive element increases in temperature. Although some heat is transferred through the panel, portion, or segment of the construct, the coating resists softening. Further, even when the panel, portion, or segment is placed into contact with the floor of the microwave oven and exposed to microwave energy, the coating does not adhere substantially to or transfer substantially to the floor of the microwave oven. The thermoset coating may be one that has been cured using UV or E-beam radiation, chemical crosslinking, or otherwise.

Additional aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DESCRIPTION

The present invention is directed generally to a carton, pouch, sleeve, package, or other construct (collectively "construct") for heating, browning, and/or crisping a food item in a microwave oven. The construct generally includes a thermally stable coating. In one aspect, a heat resistant coating overlies at least a portion of the outer surface. In another aspect, the construct includes at least one outer surface including a thermoset polymer coating (sometimes referred to herein as a "thermoset coating"), optionally overlying an ink or other substance. The construct also may include one or more microwave energy interactive elements. One of such elements may overlie a surface opposite the thermoset coating, for example, on an opposite side of the same panel. Unlike typical thermoplastic coatings, the thermoset coating resists softening when the food item is heated. Thus, even where the thermoset coating overlies the bottom surface of a construct, the coating remains intact during heating. This provides an advantage over thermoplastic coatings, which are prone to unsightly picking or other marring.

Figure 1A:
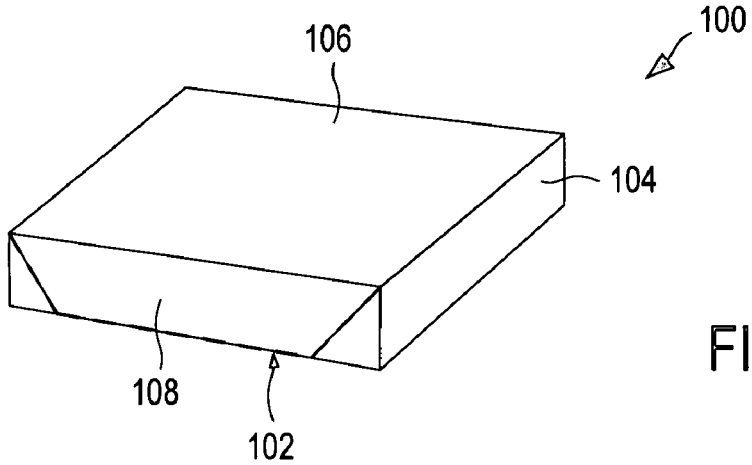
FIG. 1A schematically depicts an exemplary carton that may be used in accordance with the invention, in a closed configuration.
Figure 1B:
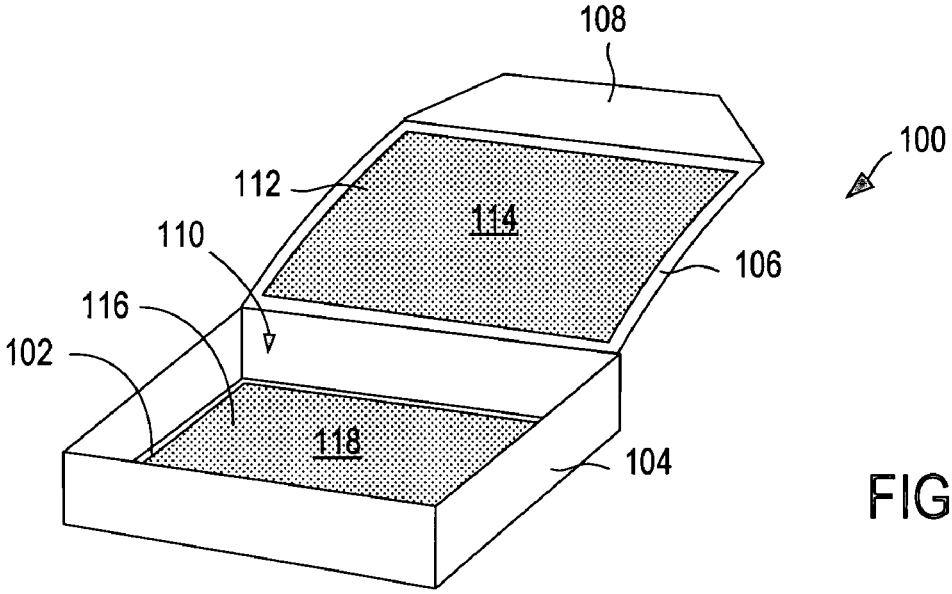
FIG. 1B schematically depicts the carton of FIG. 1A in an open configuration.
Figure 1C:
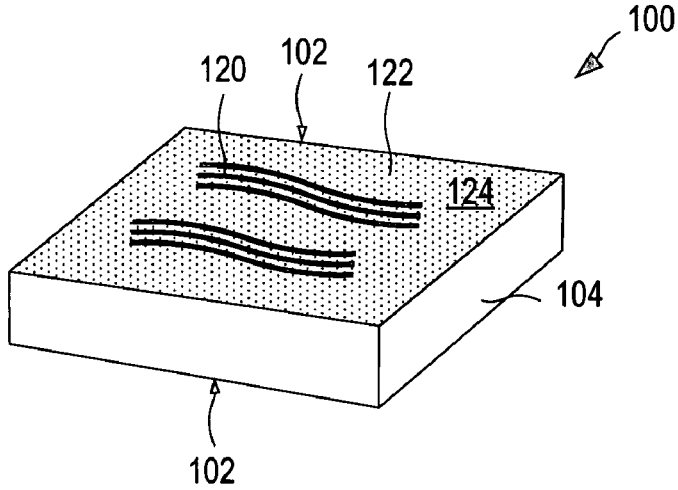
FIG. 1C schematically depicts the carton of FIG. 1A in an inverted configuration.

FIGS. 1A-1C depict an exemplary conventional carton 100 that may be used in accordance with the invention. The carton 100 includes a base or bottom panel 102 (FIG. 1C), a plurality of upstanding walls 104, a top panel 106, and a closure flap 108. The bottom panel 102, walls 104, and top panel 106 define an interior space 110 for receiving one or more food items (not shown), as shown in FIG. 1B, which illustrates the carton 100 in an open configuration.

Still viewing FIG. 1B, a microwave energy interactive element 112 (schematically shown by heavy stippling) may overlie and may be joined to at least a portion of the interior face of the top panel 106, such that the interior surface 114 of the top panel 106 is at least partially defined by the microwave energy interactive element 112. Likewise, a microwave energy interactive element 116 (schematically shown by heavy stippling) may overlie and may be joined to at least a portion of the interior face of the bottom panel 102, such that the interior surface 118 of the bottom panel 102 is at least partially defined by the microwave energy interactive element 116.

In one example, at least one of the microwave energy interactive elements 112, 116 comprises a susceptor (typically provided as a susceptor film) that converts microwave energy to thermal energy. In another example, at least element 116 comprises a susceptor (typically provided as a susceptor film). Such elements may be used to enhance the heating, browning, and/or crisping of a food item heated within the carton 100. Other microwave energy interactive elements are contemplated for use with the invention, as will be discussed in detail below.

FIG. 1C illustrates the carton 100 in an inverted configuration, revealing the exterior face of the bottom panel 102, which may include graphics, text, and/or other information (collectively "information") 120, schematically illustrated in FIG. 1C with a plurality of wavy lines. Such information 120 may be printed or otherwise applied to the carton 100. A heat resistant coating 122 (schematically shown by light stippling in FIG. 1C) may overlie the information 120, thereby defining at least a portion of the exterior surface 124 of the bottom panel. The coating 122 serves as an overprint varnish that protects the printed information 120 from abrasion or other damage during manufacture, shipping, sale, storage, and use.

In one aspect, the coating 122 comprises a thermoset polymer, and therefore, is resistant to softening in the presence of thermal energy, or heat. The coating 122 may be crosslinked or otherwise cured using electron beam radiation, ultraviolet radiation, a chemical initiator, or using any other technique. The various coatings contemplated by the invention may include colorants, leveling agents, or any other additive, as is understood by those of skill in the art. Other panels may include such coatings if desired.

To use the carton 100 according to one exemplary method, one or more food items (generally "food item" sometimes herein, not shown) may be placed into or may be provided in the interior space 110 of the carton 100 overlying the microwave energy interactive element 116 on the bottom panel 102, such surface 118 serves as a food-bearing surface. The top panel 106 may be folded downwardly and the flap 108 tucked into the interior 110 of the carton 100 to secure it in a closed position. The carton 100 with the food item inside may be placed into a microwave oven with the bottom panel 102 seated on the floor or turntable (generally referred to herein as "floor") of the microwave oven. In this manner, surface 124 serves as a microwave oven-contacting surface. The food item then may be heated, typically according to package directions.

As the carton 100 is exposed to microwave energy, the susceptor patches 112, 116 tend to convert the microwave energy to thermal energy, which then can be transferred to an adjacent surface of the food item. Although some heat also may be transferred from the susceptor patch 116 through the bottom panel 102 to the outer surface 120 of the bottom panel 102, the coating 122 of the present invention resists softening. As a result, the carton 100 can be removed from the microwave oven without the unsightly "picking" or transfer of coating 122 and/or printed information 120 to the turntable or bottom of the microwave oven.

Numerous thermoset coatings may be suitable for use with the present invention. In general, any coating may be used, provided that the coating resists deformation, flow, or softening at typical microwave heating temperatures, with temperatures ranging from about 250° F. to about 425° F. The particular coating selected may depend on various factors including, but not limited to, the physical and chemical properties of the coating before and after crosslinking, the aesthetic properties of the thermoset coating, the safety of the coating for use in food heating applications, and various other factors that will be appreciated by those of skill in the art. Examples of such properties that may be considered for a particular application may include, but are not limited to, molecular weight, molecular weight distribution, glass transition temperature, crosslink density, gloss, coefficient of friction, adhesion to ink, paper, and paperboard, ease of cure, performance in the presence of water and water vapor at elevated temperatures, and ability to withstand microwave susceptor temperatures without emitting unpleasant and/or dangerous by-products. In general, it can be said that polymers having a higher molecular weight, glass transition temperature, and/or crosslink density are more resistant to picking than polymers having a lower molecular weight, glass transition temperature, and/or a crosslink density. However, it will be understood that any of numerous properties may be considered when selecting a coating for use with the present invention.

Examples of coatings that may be suitable for use with the invention include crosslinkable (i.e., curable) acrylic coatings, including polymers or copolymers of acrylic acid, methacrylic acid, esters of these acids, or acrylonitrile. In one particular example, the coating may comprise a curable acrylate coating, for example, a UV-curable acrylate coating. Other examples include phenolic, epoxy, polyester, polyurethane, and silicone polymers. However, numerous other coatings containing, consisting of, consisting essentially of, or comprising numerous other thermoset or self-crosslinking polymers may be used in accordance with the invention.

The coating may have any suitable "dry" coating weight (or simply "coating weight"), as needed or desired for a particular application. In one example, the coating weight is from about 0.5 to about 5 grams/square meter (gsm). In a more particular example, the coating weight is from about 1 to about 2 gsm.

Figure 2A:
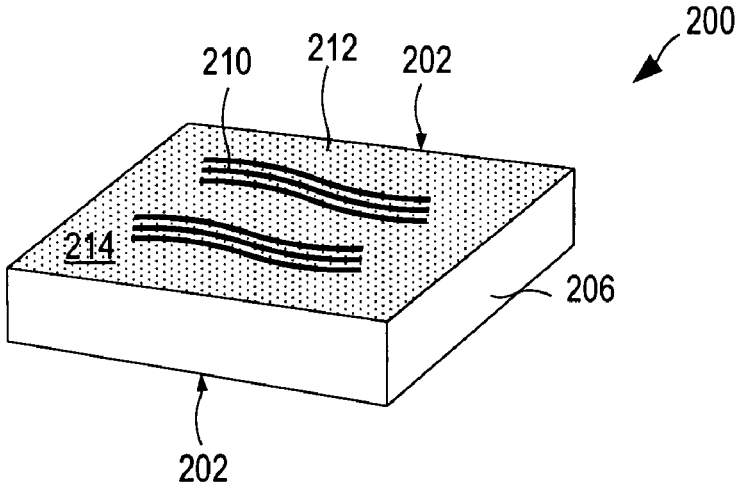
FIG. 2A depicts another exemplary carton that may be used in accordance with the invention, in a closed configuration.
Figure 2B:
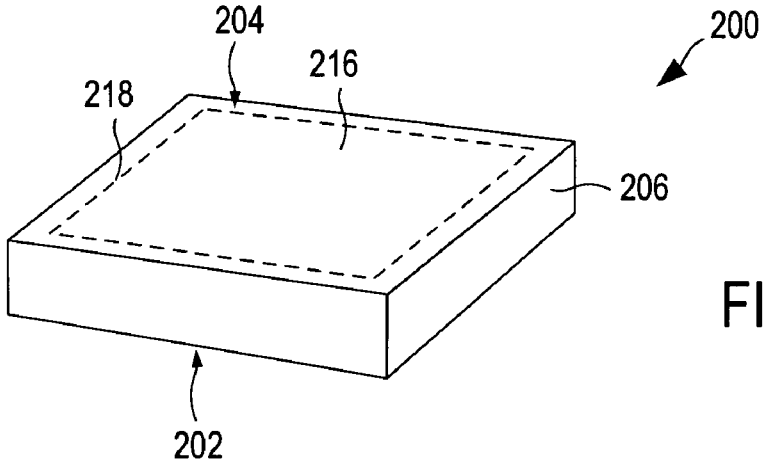
FIG. 2B schematically depicts the carton of FIG. 2A in an inverted configuration, revealing a removable portion.
Figure 2C:
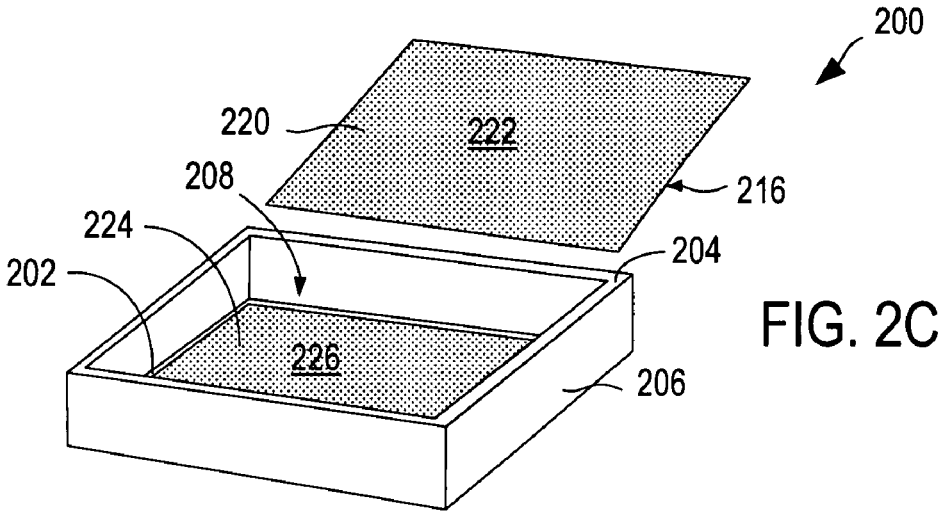
FIG. 2C schematically depicts the carton of FIGS. 2A and 2B in an inverted configuration, with the removable portion separated from the remainder of the carton.

FIGS. 2A-2C schematically illustrate another exemplary carton 200 that may be suitable for use with the invention. The carton 200 includes a first panel 202 and a second panel 204 in an opposed relationship, adjoined by substantially upstanding walls 206. The first panel 202, second panel 204, and walls 206 collectively define an interior space 208 for receiving one or more food items (not shown). The outside face of the first panel 202 includes printed information 210, illustrated schematically with wavy lines. A heat resistant coating 212 (schematically shown by light stippling) substantially overlies the printed information 210 and at least partially defines the exterior surface 214 of the first panel 202.

FIG. 2B depicts the carton 200 in an inverted configuration, schematically illustrating the outer face of the second panel 204. The second panel 204 includes a removable portion 216 defined by a score line, tear line, or other line of disruption 218. In this example, the removable portion 216 is substantially square in shape. However, numerous other regular and irregular shapes may be used.

Turning to FIG. 2C, the removable portion 216 may be separated from the remainder of the second panel 204 to form a card 216 and to reveal the interior space 208 of the carton 200. As shown in FIG. 2C, a microwave energy interactive element 220 (schematically shown by heavy stippling) may overlie and may be joined to at least a portion of the interior face of the card 216, such that the interior surface 222 of the card 216 is at least partially defined by the microwave energy interactive element 220. Likewise, a microwave energy interactive element 224 (schematically shown by heavy stippling) may overlie and may be joined to at least a portion of the interior face of the first panel 202, such that the interior surface 226 of the bottom panel 202 is at least partially defined by the microwave energy interactive element 224. Either or both of the microwave energy interactive elements 220, 224 may comprise a susceptor, which typically is provided as a susceptor film.

According to one exemplary method, prior to heating, the food item(s) may be arranged on the interior surface 220 of the first panel 202, which serves as a food-bearing surface. The card 216 is placed on top of the food items within the interior space 208 to bring the microwave energy interactive element 220 into proximate and/or intimate contact with the surface of the food item. Thus, the removable portion or card 216 serves as a top panel that overlies the food item and panel 202 serves as a bottom panel that is seated on the floor of a microwave oven. In this configuration, the heat resistant, thermoset coating 212 contacts the floor of the microwave oven.

When exposed to microwave energy, the microwave energy interactive elements 220, 224, for example, susceptors, may tend to generate thermal energy or heat. At least a portion of the heat may transfer through panel 202 to the printed information 210 and the coating 212 on the opposite side of the first panel 202. After heating, the construct 200 may be removed from the microwave oven. While typical thermoplastic coatings might tend to adhere to the floor of the microwave oven, the heat resistant, thermoset coating 212 used in accordance with the invention typically remains intact.

Numerous other constructs may be used in accordance with the invention. By way of example, and not limitation, the present invention may be embodied in any other carton, a pouch, a sleeve, a card, a tray, a platform, a sheet, a wrapper, or any other container. The various constructs may have any shape, for example, triangular, square, rectangular, circular, oval, pentagonal, hexagonal, octagonal, or any other shape. The shape of the construct may be determined by the shape and portion size of the food item or items being heated, and it should be understood that different packages are contemplated for different food items and combinations of food items, for example, dough-based food items, breaded food items, sandwiches, pizzas, French fries, soft pretzels, chicken nuggets or strips, fried chicken, pizza bites, cheese sticks, pastries, doughs, egg rolls, soups, dipping sauces, gravy, vegetables, and so forth.

As stated previously, the various constructs may include one or more microwave energy interactive elements that alter the effect of microwave energy during the heating or cooking of the food item. For example, the construct may include one or more microwave energy interactive elements that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating application. The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such structures may be referred to herein as "microwave interactive webs".

In one example, the microwave interactive element may comprise a thin layer of microwave interactive material that tends to absorb microwave energy, thereby generating heat at the interface with a food item. Such elements often are used to promote browning and/or crisping of the surface of a food item. When supported on a film or other substrate, such an element may be referred to as a "susceptor film" or, simply, "susceptor". Such elements are discussed in connection with FIGS. 1A-2C.

As another example, the microwave interactive element may comprise a foil having a thickness sufficient to shield one or more selected portions of the food item from microwave energy. Shielding elements may be used where the food item is prone to scorching or drying out during heating.

A shielding element may be formed from various materials and may have various configurations, depending on the particular application. Typically, a shielding element is formed from a conductive, reflective metal or metal alloy, for example, aluminum, copper, or stainless steel. The shielding element generally has a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Segmented foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

Various materials may be suitable for use in forming the numerous constructs of the invention, provided that the materials are resistant to softening, scorching, combusting, or degrading at typical microwave oven heating temperatures, for example, at from about 250° F. to about 425° F. Such materials may include microwave energy interactive materials and microwave energy transparent or inactive materials, including the various coatings of the invention.

For example, the microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

As stated above, any of the above elements and numerous others contemplated hereby may be supported on a substrate. The substrate typically comprises an electrical insulator, for example, a polymer film or other polymeric material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one example, the barrier film has an OTR of less than about 10 $cc/m^2/day$. In another example, the barrier film has an OTR of less than about 1 $cc/m^2/day$. In still another example, the barrier film has an OTR of less than about 0.5 $cc/m^2/day$. In yet another example, the barrier film has an OTR of less than about 0.1 $cc/m^2/day$.

The barrier film may have a water vapor transmission rate (WVTR) of less than about 100 $g/m^2/day$ as measured using ASTM F1249. In one example, the barrier film has a WVTR of less than about 50 $g/m^2/day$. In another example, the barrier film has a WVTR of less than about 15 $g/m^2/day$. In yet another example, the barrier film has a WVTR of less than about 1 $g/m^2/day$. In still another example, the barrier film has a WVTR of less than about 0.1 $g/m^2/day$. In a still further example, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream (lb/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

Alternatively, where a flexible construct is to be formed, for example, the support may comprise a polymer or polymeric material, such as those described above. Examples of polymers that may be suitable for use with the present invention include, but are not limited to, polycarbonate; polyolefins, e.g. polyethylene, polypropylene, polybutylene, and copolymers thereof; polytetrafluoroethylene; polyesters, e.g. polyethylene terephthalate, e.g., coextruded polyethylene terephthalate; vinyl polymers, e.g., polyvinyl chloride, polyvinyl alcohol, ethylene vinyl alcohol, polyvinylidene chloride, polyvinyl acetate, polyvinyl chloride acetate, polyvinyl butyral; acrylic resins, e.g. polyacrylate, polymethylacrylate, and polymethylmethacrylate; polyamides, e.g., nylon 6,6; polystyrenes; polyurethanes; cellulosic resins, e.g., cellulosic nitrate, cellulosic acetate, cellulosic acetate butyrate, ethyl cellulose; copolymers of any of the above materials; or any blend or combination thereof. Other materials are contemplated hereby.

In another aspect, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. The coating may then be printed over with product advertising or other information or images. The blanks or other constructs also may be coated to protect any information printed thereon, as described above.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent structures including at least one microwave energy interactive elements are described in U.S. Provisional Application No. 60/604,637, U.S. Patent Application Publication No. US 2006-0049190 A1, and U.S. patent application Ser. No. 11/673,136, each of which is incorporated herein by reference in its entirety.

If desired, a combination of paper layers, polymer film layers, and microwave interactive elements may be used to form a microwave energy interactive insulating material. As used herein, the term "microwave energy interactive insulating material" or "microwave interactive insulating material" or "insulating material" refers any combination of layered materials that is both responsive to microwave energy and capable of providing some degree of thermal insulation when used to heat a food item.

In one aspect, the insulating material comprises one or more susceptor layers in combination with one or more expandable insulating cells. Such materials sometimes may be referred to herein as "expandable cell insulating materials". Additionally, the insulating material may include one or more microwave energy transparent or inactive materials to provide dimensional stability, to improve ease of handling the microwave energy interactive material, and/or to prevent contact between the microwave energy interactive material and the food item.

In another aspect, the insulating material may comprise a microwave energy interactive material supported on a first polymer film layer, a moisture-containing layer superposed with the microwave energy interactive material, and a second polymer film layer joined to the moisture-containing layer in a predetermined pattern using an adhesive, chemical or thermal bonding, or other fastening agent or process, thereby forming one or more closed cells between the moisture-containing layer and the second polymer film layer. The microwave energy interactive material may serve as a susceptor. The closed cells may expand or inflate in response to being exposed to microwave energy and cause the susceptor to bulge and deform toward the food item.

While not wishing to be bound by theory, it is believed that the heat generated by the susceptor causes moisture in the moisture-containing layer to evaporate, thereby exerting pressure on the adjacent layers. As a result, the expandable cells bulge outwardly away from the expanding gas, thereby allowing the expandable cell insulating material to conform more closely to the contours of the surface of the food item. As a result, the heating, browning, and/or crisping of the food item can be enhanced, even if the surface of the food item is somewhat irregular.

Further, the water vapor, air, and other gases contained in the closed cells provide insulation between the food item and the ambient environment of the microwave oven, thereby increasing the amount of sensible heat that stays within or is transferred to the food item. Such insulating materials also may help to retain moisture in the food item when cooking in the microwave oven, thereby improving the texture and flavor of the food item. Additional benefits and aspects of such materials are described in PCT Publication No. WO 2003/66435, U.S. Pat. No. 7,019,271, and U.S. Patent Application Publication No. US 2006-0113300 A1, each of which is incorporated by reference herein in its entirety.

It also is contemplated that expandable cell insulating structures that inflate without moisture-containing layers, such as paper, also may be used in accordance with the invention. Additional examples of such materials are provided in U.S. Patent Application Publication No. US 2006-0278521 A1, which is incorporated by reference herein in its entirety.

It will be understood that with some combinations of elements and materials, the microwave interactive element may have a grey or silver color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

The present invention may be understood further with reference to the following examples, which are not to be construed as limiting in any manner.

Example 1

About 170 g of crinkle cut French fries were placed in a substantially single layer in a carton similar to that of FIGS. 2A-2C, except that the coating on the outside surface of the food-bearing panel or "bottom" panel in contact with the floor of the microwave oven comprised a non-crosslinked, thermoplastic, water-based coating. The removable portion of the carton was removed according to instructions and placed directly on top of the French fries. The package and French fries were placed into a conventional microwave oven and heated for about 4 minutes. After heating, the package was removed from the microwave oven and evaluated for blistering and picking.

Various non-crosslinked, thermoplastic experimental water based coatings were evaluated according to the above procedure. Each exhibited blistering and/or picking when removed from the microwave oven.

Example 2

The procedure of Example 1 was repeated, except that the coating on the bottom panel comprised 1 gsm Flint RMW96220 primer (waterbased crosslinkable acrylic coating proprietary to Flint Group North America (Plymouth, Mich.). After heating, the package was removed from the microwave oven and evaluated for blistering and picking. No blistering or picking was observed.

Example 3

The procedure of Example 1 was repeated, except that the coating on the bottom panel comprised 2.5 gsm Sun Chemical UV curable acrylate coating RCMVF0341835 (available from Sun Chemical Corporation (Parsippany, N.J.), crosslinked using ultraviolet radiation). After heating, the package was removed from the microwave oven and evaluated for blistering and picking. No blistering or picking was observed.

Example 4

An experimental procedure was developed to predict whether various coatings on the exterior of a microwavable package would be susceptible to picking after being used to heat a food item in a microwave oven. First, a Sentinel heat sealer is set at a temperature of about 400° F. and 90 psi. Next, two coated constructs (e.g. cartons) are placed in the heat sealer with the coatings facing each other. The heat sealer is closed and maintained in a closed position to achieve a dwell time of about 95 seconds. After heating, the constructs are pulled in a direction away from one another to determine whether the constructs stick to each other.

The construct of Example 3 was evaluated according to this procedure. No picking or sticking was observed.

Example 5

A Red Baron pizza carton having an electron beam crosslinked coating including 2.5 gsm Sun Chemical EB curable acrylate coating RCHWB0488594 (available from Sun Chemical Corporation, Parsippany, N.J.) on the exterior side of the bottom panel was evaluated according to the procedure described in Example 4. No picking or sticking was observed.

Examples 6-10

Various water-based acrylic coatings were evaluated according to the procedure set forth in Example 4. The results are presented in Table 1.

TABLE 1

| Example | Coating name | Manufacturer | Coat weight (gsm) | Results |
|---|---|---|---|---|
| 6 | Algan A795N | Lubrizol Advanced Materials Inc. (Cleveland, Ohio) | 1 | Severe picking |
| 7 | GPIC | Coatings and Adhesives Corporation (Leland, NC) | 1 | Severe picking |
| 8 | 1353C | Coatings and Adhesives Corporation (Leland, NC) | 1 | Slight picking |
| 9 | RMW96220 | Flint Group North America (Plymouth, Michigan) | 1 | Slight picking |
| 10 | FWBM9A2MF | Siegwerk USA Inc (Neenah, WI) | 1 | Very slight picking |

Examples 11-12

Various UV-curable acrylate coatings were evaluated according to the procedure described in Example 4. The results are presented in Table 2.

TABLE 2

| Example | Coating name | Manufacturer | Coat weight (gsm) | Results |
|---|---|---|---|---|
| 11 | RCMFV0341835 | Sun Chemical Corporation (Parsippany, NJ) | 2.5 | No picking |
| 12 | RZW1020 | Flint Group North America (Plymouth, Michigan) | 2.5 | No picking |

TABLE 2-continued

Although certain embodiments of this invention have been described with a certain degree of particularity, those skilled in the art could make numerous alterations to the disclosed embodiments without departing from the spirit or scope of this invention. All directional references (e.g., over, under, inner, outer, upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A construct for heating, browning, and/or crisping a food item in a microwave oven, comprising:

a panel having a first side and a second side opposite the first side;

microwave energy interactive material overlying at least a portion of the first side of the panel surface, the microwave energy interactive material being operative for generating heat when exposed to microwave energy, wherein the microwave energy interactive material is supported on a polymer film that at least partially defines a first surface of the construct, the first surface being for contacting the food item; and a heat-resistant coating disposed on at least a portion of the second side of the panel, such that the panel is disposed between the microwave energy interactive material and the heat-resistant coating, wherein the heat-resistant coating comprises a thermoset polymer that at least partially defines a second surface of the construct, wherein the second surface of the construct is opposite from the first surface of the construct.

2. The construct of claim 1, wherein the thermoset polymer is an acrylate polymer.

3. The construct of claim 1, wherein the heat-resistant coating has a coating weight of from about 0.5 to about 5 grams/square meter.

4. The construct of claim 1, wherein the heat-resistant coating has a coating weight of from about 1 to about 2 grams/square meter.

5. The construct of claim 1, wherein the heat-resistant coating overlies printed graphics, text, or any combination thereof.

6. The construct of claim 1, wherein the microwave energy interactive material comprises a susceptor.

7. The construct of claim 1, wherein the heat-resistant coating is for being in a substantially contacting relationship with the floor of the microwave oven.

8. The construct of claim 1, wherein the first panel is a bottom panel, and the construct further comprises a plurality of walls extending upwardly from the bottom panel; and a top panel having an interior surface comprising microwave energy interactive material.

9. The construct of claim 8, wherein the microwave energy interactive material of the top panel comprises a susceptor.

10. A microwave heating package, comprising:

a plurality of panels including a first panel having an interior side and an exterior side;

a susceptor film joined to the interior side of the first panel, the susceptor film comprising microwave energy interactive material disposed on a polymer film, wherein the polymer film at least partially defines an interior surface of the package;

ink disposed on the exterior side of the first panel; and a thermoset coating disposed on the exterior side of the first panel so that the ink is disposed between the thermoset coating and the exterior side of the first panel, wherein the thermoset coating at least partially defines an exterior surface of the package.

11. The microwave heating package of claim 10, wherein the thermoset coating comprises an acrylate polymer.

12. The microwave heating package of claim 10, wherein the thermoset coating has a coating weight of from about 0.5 to about 5 grams/square meter.

13. The microwave heating package of claim 10, wherein the thermoset coating has a coating weight of from about 1 to about 2 grams/square meter.

14. The microwave heating package of claim 10, wherein upon exposure to microwave energy, the microwave energy interactive material generates thermal energy, at least a portion of the thermal energy is transferred to the thermoset coating, and the thermoset coating does not soften or flow when exposed to the thermal energy.

15. The microwave heating package of claim 10, wherein the thermoset coating resists softening up to a temperature of about 450° F.

* * * * *